US007227069B1

(12) United States Patent
Sanderson

(10) Patent No.: US 7,227,069 B1
(45) Date of Patent: Jun. 5, 2007

(54) INSERTABLE PIANO/KEYBOARD STRIP FOR SENSING KEY MOVEMENT

(76) Inventor: Stephen N. Sanderson, 3560 San Pedro Dr. NE., Albuquerque, NM (US) 87110

( * ) Notice: Subject to any disclaimer, the term of this patent is extended or adjusted under 35 U.S.C. 154(b) by 120 days.

(21) Appl. No.: 10/762,672

(22) Filed: Jan. 21, 2004

Related U.S. Application Data

(60) Provisional application No. 60/441,057, filed on Jan. 21, 2003.

(51) Int. Cl.
*G10C 3/12* (2006.01)
*G10H 3/00* (2006.01)

(52) U.S. Cl. ..... 84/423 R; 84/744; 84/462; 84/21; 84/626; 400/708

(58) Field of Classification Search ..... 84/724, 84/423 R, 433, 477 R, 478, 137, 169, 645, 84/462, 658, 171, 453, 744, 21, 626; 250/229; 341/31; 356/28; 400/708
See application file for complete search history.

(56) References Cited

U.S. PATENT DOCUMENTS

| | | | | |
|---|---|---|---|---|
| 4,790,230 | A * | 12/1988 | Sanderson | 84/462 |
| 4,818,132 | A * | 4/1989 | Brull et al. | 400/708 |
| 5,231,283 | A | 7/1993 | Starkey et al. | 250/229 |
| 5,237,125 | A * | 8/1993 | Fields | 84/626 |
| 5,567,902 | A | 10/1996 | Kimble et al. | 84/658 |
| 5,763,806 | A | 6/1998 | Willis | 84/645 |
| 6,037,534 | A * | 3/2000 | Yasutoshi et al. | 84/477 R |
| 6,472,589 | B1 * | 10/2002 | Lee | 84/21 |
| 6,777,604 | B1 | 8/2004 | Sanderson | 84/423 R |
| 2001/0045151 | A1 * | 11/2001 | Hayakawa | 84/462 |
| 2004/0003708 | A1 | 1/2004 | Buchla | 84/724 |
| 2004/0074379 | A1 | 4/2004 | Ludwig | 84/645 |

* cited by examiner

*Primary Examiner*—Lincoln Donovan
*Assistant Examiner*—Christina Russell
(74) *Attorney, Agent, or Firm*—Deborah A. Peacock; Jeffrey D. Myers; Peacock Myers, P.C.

(57) ABSTRACT

A portable modular device for the purpose of sensing key movement of a piano or keyboard, processing key movement information, and communicating at least key-note ON/OFF and key-note velocity information. A portion of the modular device, the key sensor strip, inserts between the keys and fallboard and mounts atop a piano or keyboard.

14 Claims, 10 Drawing Sheets

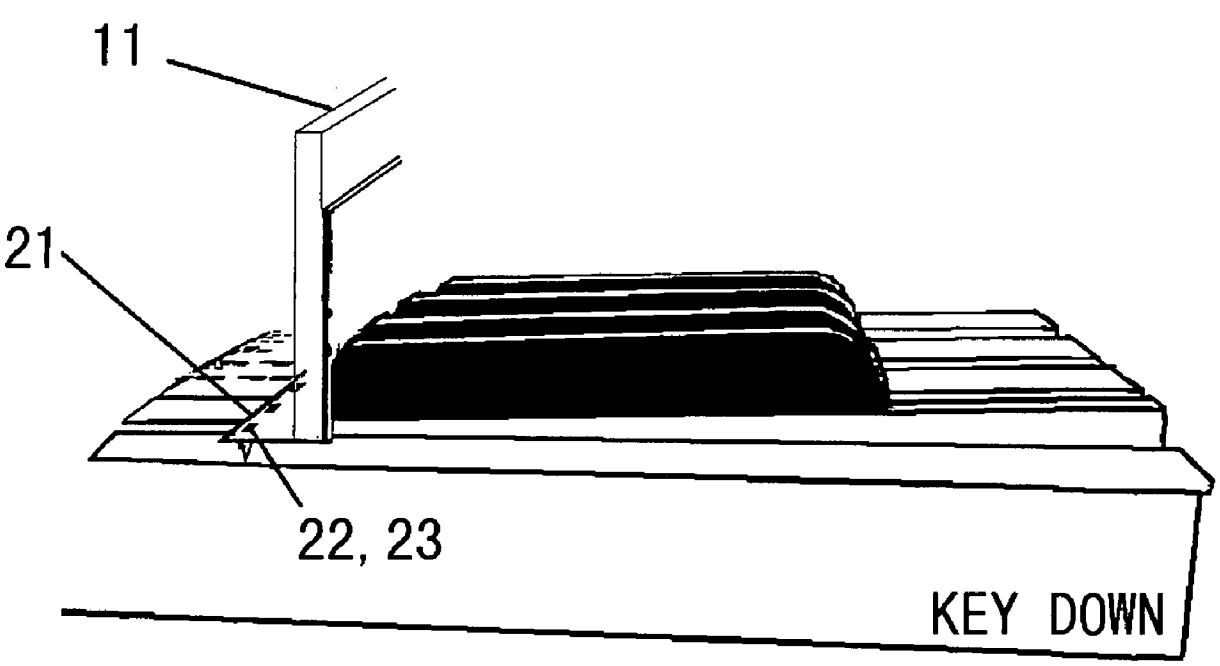
FIG 2C
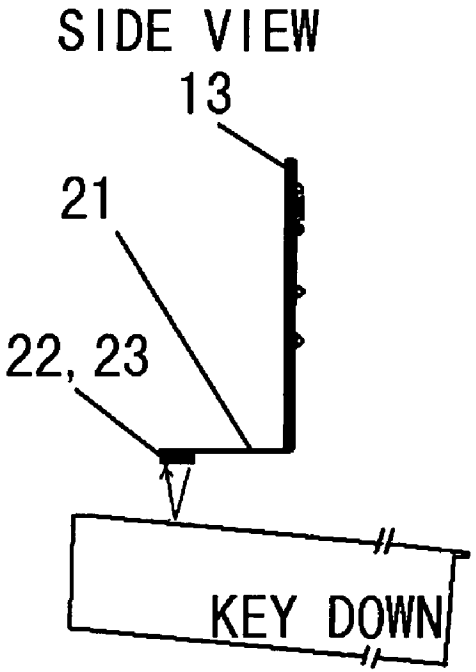

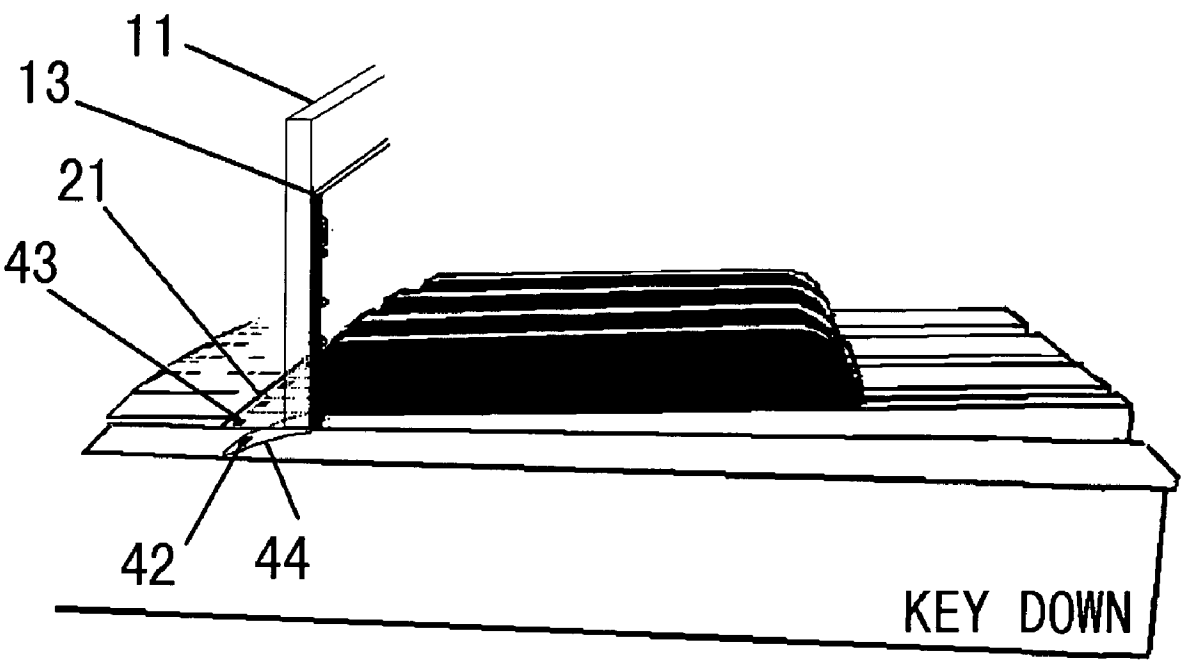
FIG 4C
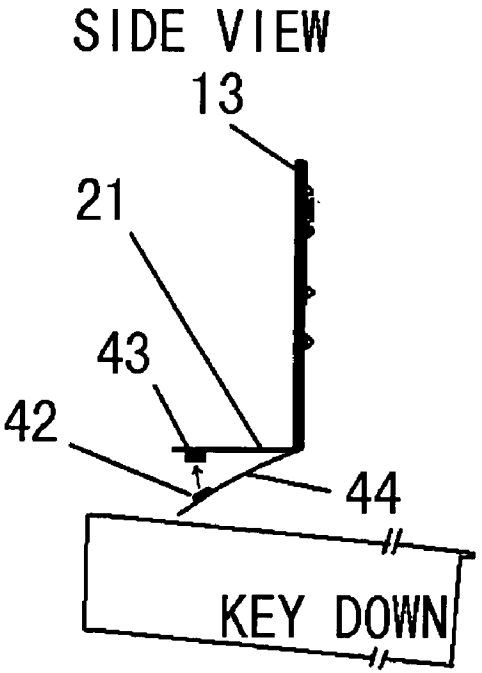

INSERTABLE PIANO/KEYBOARD STRIP FOR SENSING KEY MOVEMENT

CROSS-REFERENCE TO RELATED APPLICATIONS

This application claims the benefit of the filing of U.S. Provisional Patent Application Ser. No. 60/441,057, entitled "Piano/Keyboard Gap Strip for Sensing Key Movement", filed on Jan. 21, 2003, and the specification thereof is incorporated herein by reference.

BACKGROUND OF THE INVENTION

1. Field of the Invention (Technical Field)

The present invention relates to a device for sensing piano or keyboard key movement using a variety of sensors that are inserted into the piano or keyboard from atop the keys.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

There have been many ways sought to detect key movement on pianos and keyboards. Electronic keyboards have the advantage of building in key detecting devices during its design and manufacturing. However, older electronic keyboards, organs, and pianos are not equipped with key detecting devices and circuitry. New pianos are coming equipped with sensor units, and older piano can be retrofitted with sensor units.

Even though there are many types of sensing technologies used in these retrofit systems, such as optical couplers, piezo-electric material, mechanical switches, and magnetic coupling, most retrofit units must be installed by disassembling pianos and installing the sensor strip internal to piano. Once inside the piano, there are other sensing techniques used by major piano manufacturers to sense key movement by placing sensors beneath the key to virtually anywhere along the key linkages points all the way up to the key-string striking mechanism.

U.S. Pat. No. 5,567,902, U.S. Pat. No. 5,231,283, and U.S. Pat. No. 5,763,806 use optical sensing techniques to sense key movement from underneath the piano keys. None of these however have addressed sensing the black and white keys from atop the keys. It would be desirable to have a portable key sensing apparatus for over the top of the keys.

U.S. Pat. No. 4,790,230 discloses a keyboard device that is mounted on top of a keyboard and uses optical sensing for detecting key movement. However, while the invention detects key movement, it uses the visible portions of the keys for key sensing. U.S. Pat. No. 4,790,230 also has a challenging effort to sense black key movement accurately due to the black color of the black keys. Further, U.S. Pat. No. 4,790,230 or any patent that uses optical techniques in a portable device for sensing key movement from atop the keys must attempt to correct or compensate key sensing information from ambient light, and in some cases protect the device from damage or erroneous key-note information due to high levels of ambient light.

When using optical sensing, it would be desirable to eliminate the ambient light problem in dealing with an optical sensing technique from atop the keyboard. It would also be desirable to not use the obvious visual portion of the keys to detect key movement because of this problem and to further reduce the size of the apparatus.

BRIEF SUMMARY OF THE INVENTION

The present invention relates to a system for use with a piano, organ, or musical keyboard. The system preferably comprises an insertable sensor disposed atop the keyboard to sense both white and black key movement and circuitry to process sensor signals and transmit at least key-note ON/OFF information and key-note velocity. The system preferably comprises an insertable sensor insertable between a top surface of keys and a bottom surface of a fallboard. The system also preferably comprises an insertable protector to protect sensors from ambient light interference.

The insertable sensor detects key depression. The system preferably comprises a sensing strip operatively connected to the sensor for sensing movement of a portion of the key hidden from view. This sensing strip operatively connects to one or more sensors per key to sense a proportional amount of hidden key movement.

The sensor preferably comprises an energy contact and a corresponding energy receiving contact that by itself or when combined with another sensor produces an electrical signal strength proportional to movement of the key. The energy contact preferably comprises an optical emitter and an optical receiver that converts reflected optical energy provided by a key surface to an electrical signal proportional to displacement of the key.

The sensing strip can be operatively connected to a flexible strip that moves in relation to an associated key and provides energy to the sensing strip that is proportional to an amount of movement of the key. The sensing strip and the flexible strip can comprise a magnetically coupled emitter and receiver that converts a magnetic field strength to a corresponding electrical signal proportional to a displacement of the key.

The sensing strip and flexible strip can comprise a capacitively coupled emitter and receiver that converts an electric field strength to a corresponding electrical signal proportional to a displacement of the key.

The system can comprise a piezo-electric strip that converts mechanical energy to a negative or positive electrical signal proportional to a pressure by which the key is depressed or released.

The system sensing strip and flexible strip can comprise two or more electrical contact point pairs electrically biased that close when the key is at rest and open sequentially as the key is depressed. The sensing strip and flexible strip can comprise two or more optical coupler switches electrically biased that are switched on when the key is at rest and open sequentially as the key is depressed.

The present invention provides protection against unwanted ambient light and does not use the visual portion atop the keys. The present invention uses the combination of internal sensing and portable installation atop the keys to sense key movement. The present invention takes advantage of the inconspicuous narrow slot formed between the fallboard and the key when any key is depressed. The present invention provides a sensor strip that is installed between the keys and fallboard. Interconnecting circuitry contained in the present invention attaches the inserted sensor strip to a local circuit board or unit that processes, analyzes, and converts the key movement into a format suitable for further transmission to a computer or musical device sharing the same protocol and physical interface such as MIDI.

The rectangular design of the external vertical circuit board provides an ideal mounting means that eliminates the need for end-mounting hardware and provides stability during use. If the gap between the black keys and the fallboard is too wide, an additional rectangular strip can be sandwiched with the external vertical circuit board and its cover to keep the present invention firmly in place. Virtually any sensing device type can be used to detect key movement from atop the keys and inserted under the fallboard.

Accordingly, it is a primary object of the present invention to provide a portable, lightweight, and unobtrusive apparatus for sensing piano/keyboard key movement that is mounted atop the keyboard and senses key movement from the portion of the white and black parts that is hidden from view.

It is another object of the present invention to disclose various ways to sense key movement.

It is another object of the present invention to provide a simple attachment means utilizing the mechanical design of the device to easily insert under the fallboard and mount atop the keyboard to eliminate ambient light from affecting the sensor strip.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the present invention. The drawings are only for the purpose of illustrating one or more preferred embodiments of the present invention and are not to be construed as limiting the present invention. In the drawings:

FIG. 2C illustrates the principle for sensing key movement using optical-transmissive coupling off the keys;

FIG. 4C illustrates the principle for sensing key movement using the various sensing devices located on both the sensing strip and the flexible strip.

DETAILED DESCRIPTION OF THE INVENTION

Figure 1:
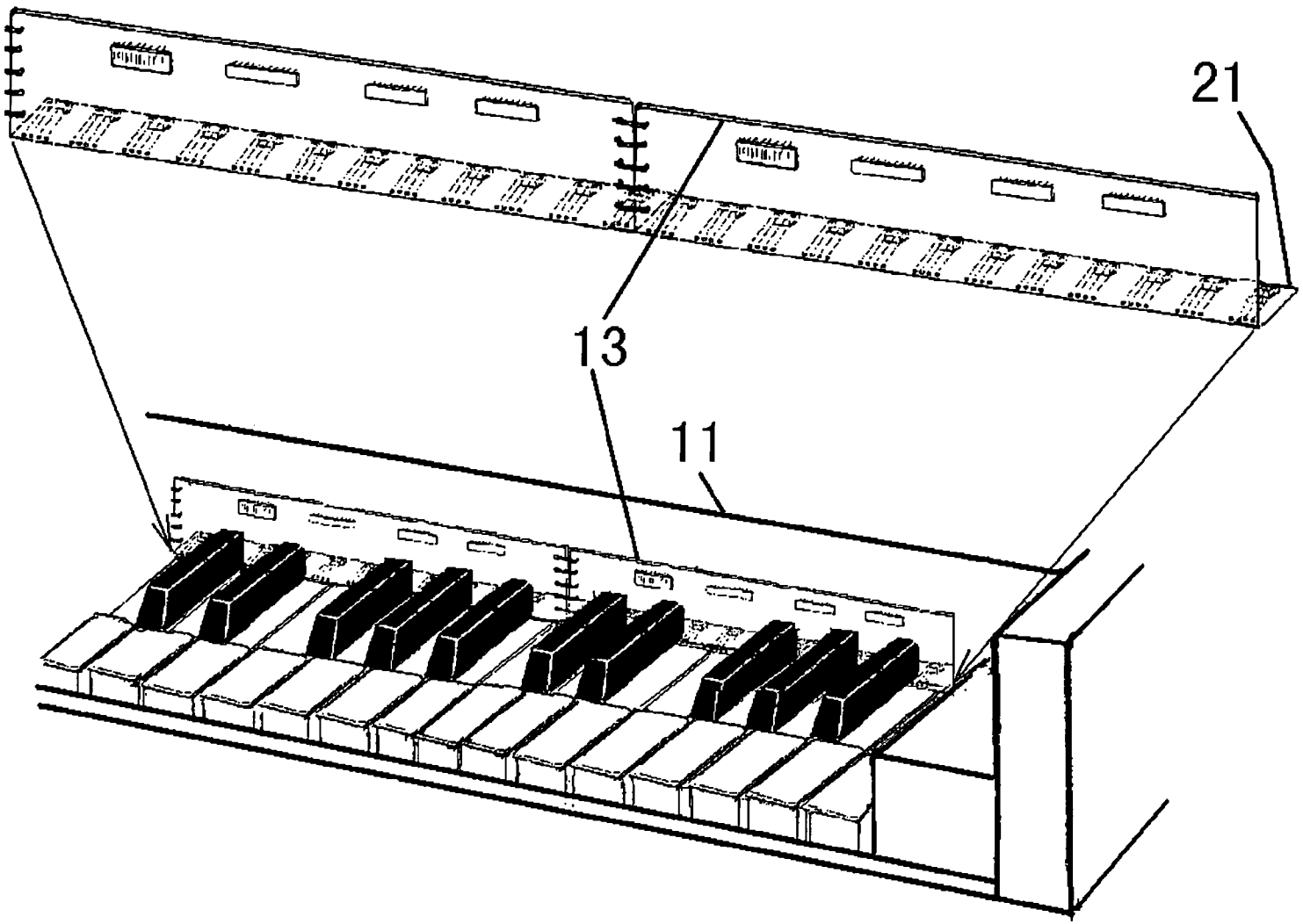
FIG. 1 is a perspective cutaway view of a representative portion of a piano/keyboard and how the present invention would appear from atop of the keyboard (the perspective view illustrates an external vertical printed circuit board operatively connected to a sensing strip that inserts into the keyboard between the keys and underneath the fallboard)

As shown in FIG. 1, the present invention is inserted into the keyboard from atop the keys with sensing strip 21 inserted between the keys and the bottom side of fallboard 11. Sensing strip 21 comprises of a thin circuit board. Sensing strip 21 electrically connects to external circuit board 13 at a right angle. Circuit board 13 sits externally while sensing strip 21 is inserted and hidden from view. Once in place, the sensing devices rest over the top of their respective internal key surfaces. Technology has advanced to ultra-miniature sensing devices to keep the profile of sensing strip 21 board and parts extremely low.

Figure 3A:
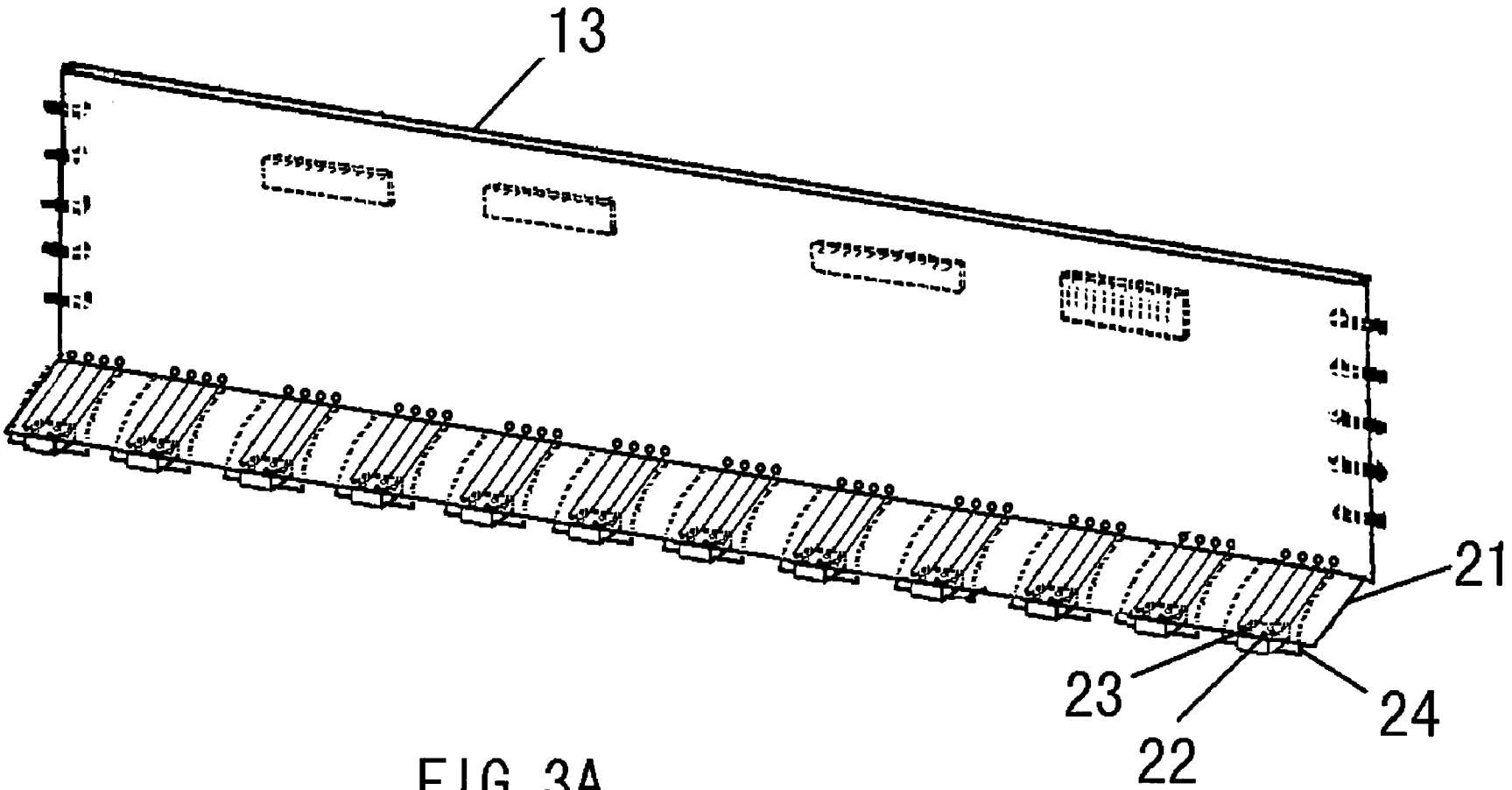
FIG. 3A illustrates a representative portion of the present invention fitted with at least one pair of optical transmissive couplers and a flexible reflective strip for each key.
Figure 3B:
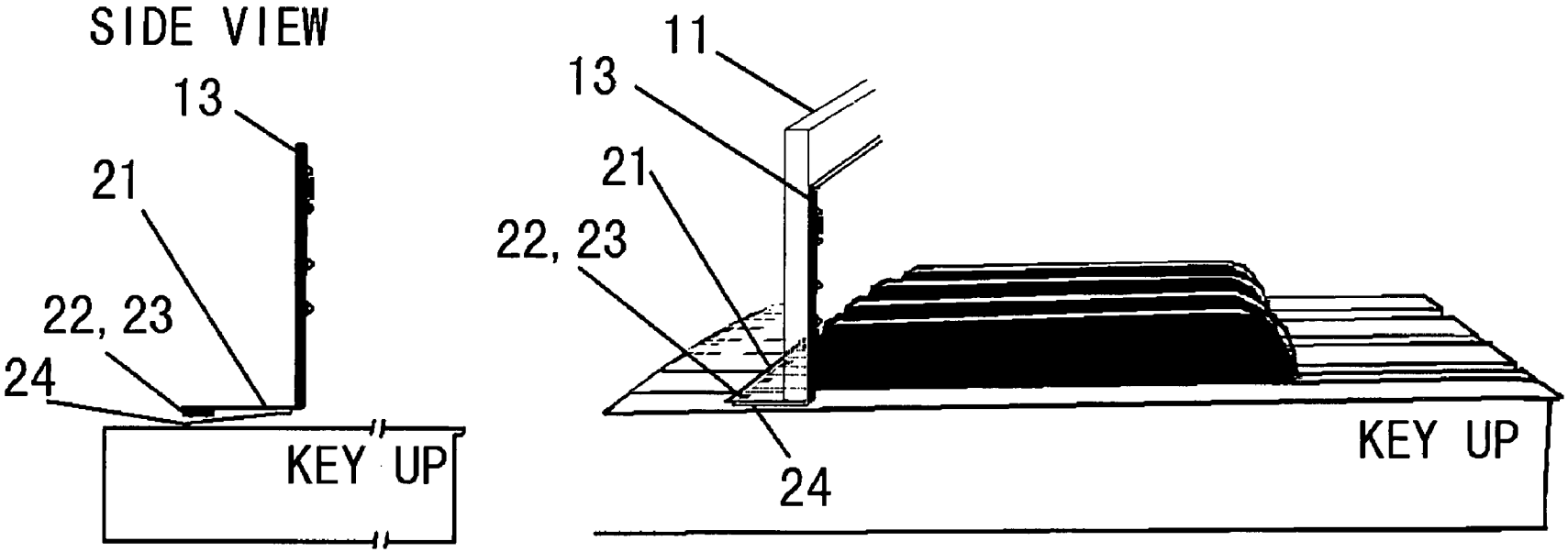
FIG. 3B illustrates how the present invention would appear after installation into the keyboard after installation into the piano keyboard.

As illustrated in FIG. 3B, when the key is in the KEY UP position, reflective flexible member 24 is at its closest proximity to the sensing strip 21. Each reflective flexible member 24, emitter 22 and receiver 23 and the amount of reflected energy is at its maximum.

Figure 3C:
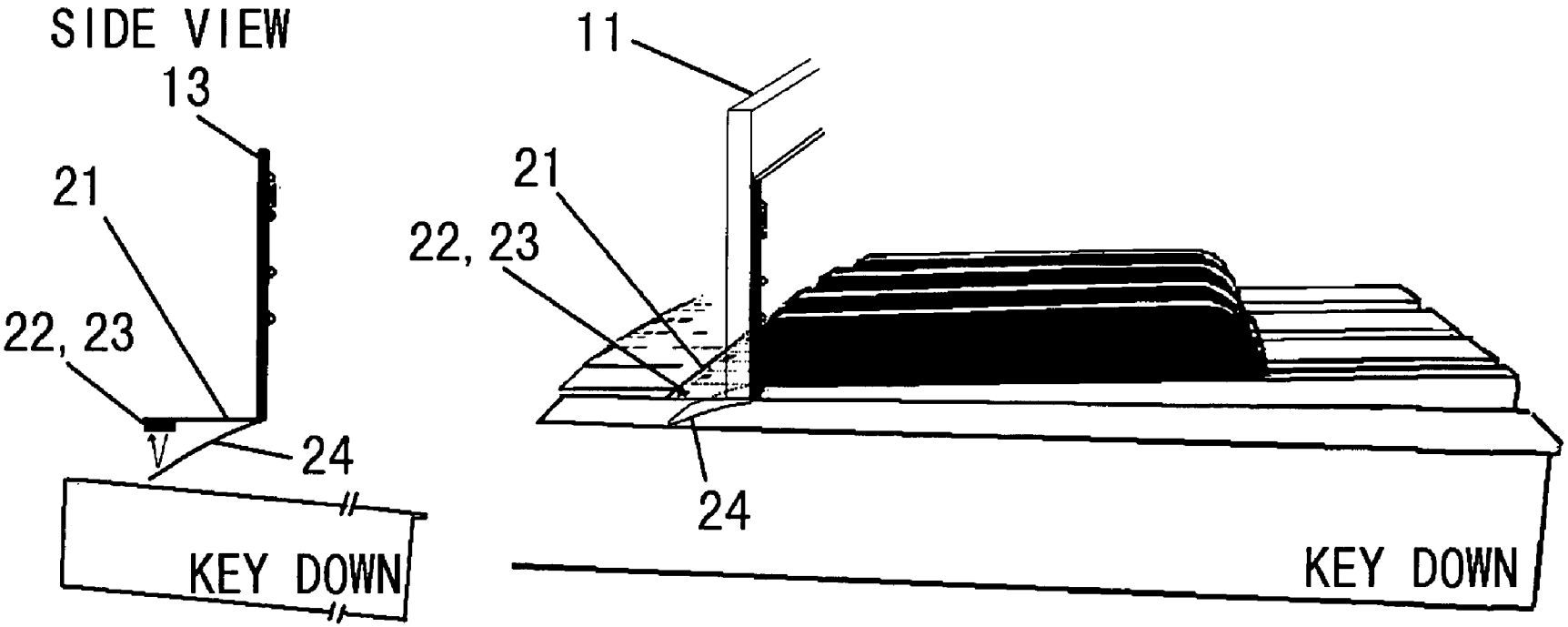
FIG. 3C illustrates the principle for sensing key movement using optical-transmissive coupling off the flexible reflective strip.
Figure 4A:
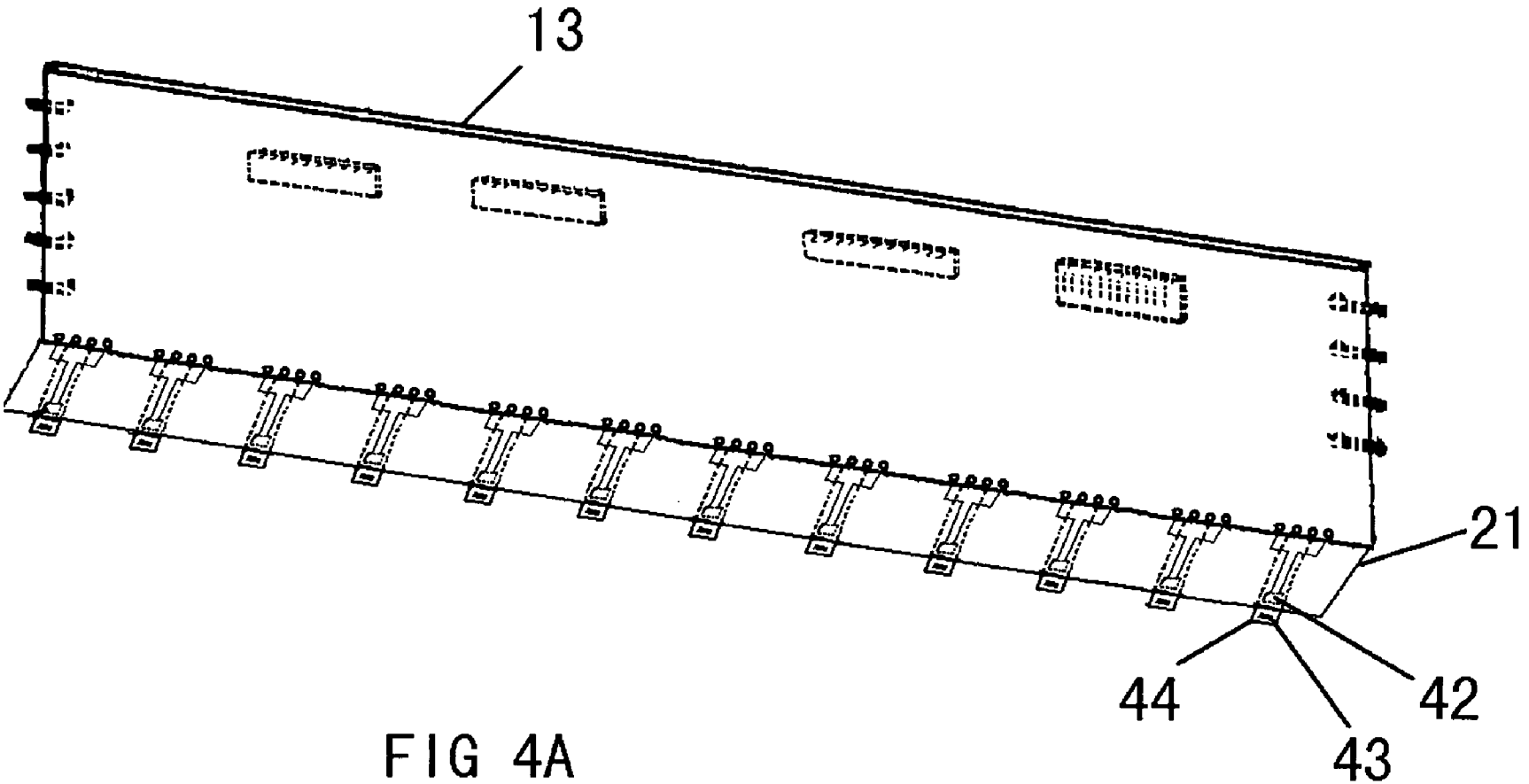
FIG. 4A illustrates a representative portion of the present invention fitted with at least one pair of discrete sensing devices that are positioned on the sensing strip and on the flexible strip member.
Figure 4B:
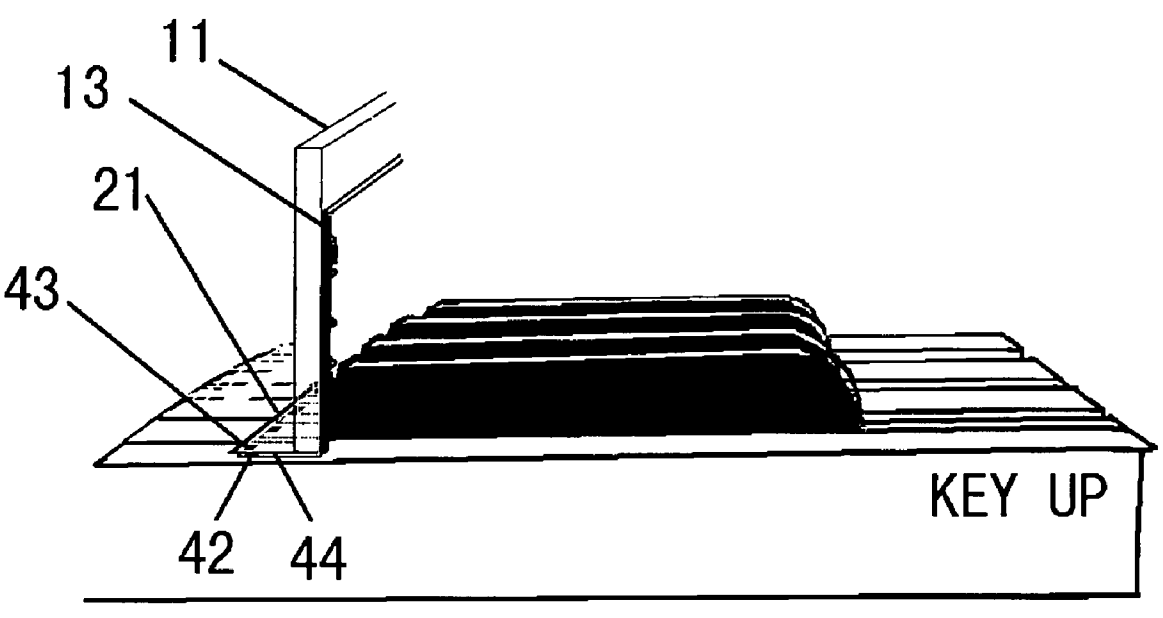
FIG. 4B illustrates how the present invention would appear after installation into the keyboard after installation into the piano keyboard.
Figure 4B:
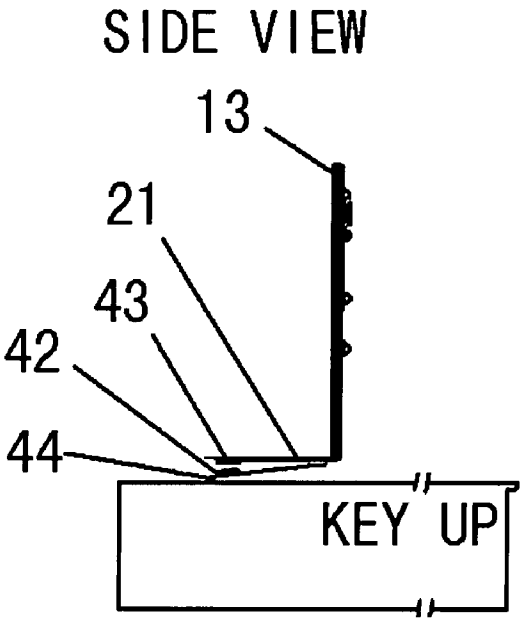

As shown in FIGS. 2–4, each sensing device provides for energy emitting device (22 or 42) and energy receiving device (23 or 43). The amount of emitted or received energy-gain is adjusted during the initialization and calibration setup of the overall system. The amount of received energy is at its maximum when the key is at rest and the amount of detected energy is at its minimum when the key is depressed. The detected received energy levels generated by the key movement detected is acquired and compared to predetermined key ON/OFF thresholds. Key movement velocity is determined based the acquisition system measurements and calculations. Sensing devices described herein are optical, magnetic, capacitive, piezo-electric, and mechanical contacts. At least one sensing device pair per key is inserted between the key and fallboard and any combination of sensing device types can be utilized for any or all keys.

In all cases, sensing receiver 23 or 43 senses emitter energy 22 or 42. With the exception of the optical transmissive coupler embodiment shown in FIG. 2, an opposing flexible strip member is used as shown in FIG. 3 and FIG. 4. In FIG. 3A, flexible reflective strip member 24 is used. In FIG. 4A, flexible circuit strip member 44 is used.

Figure 2A:
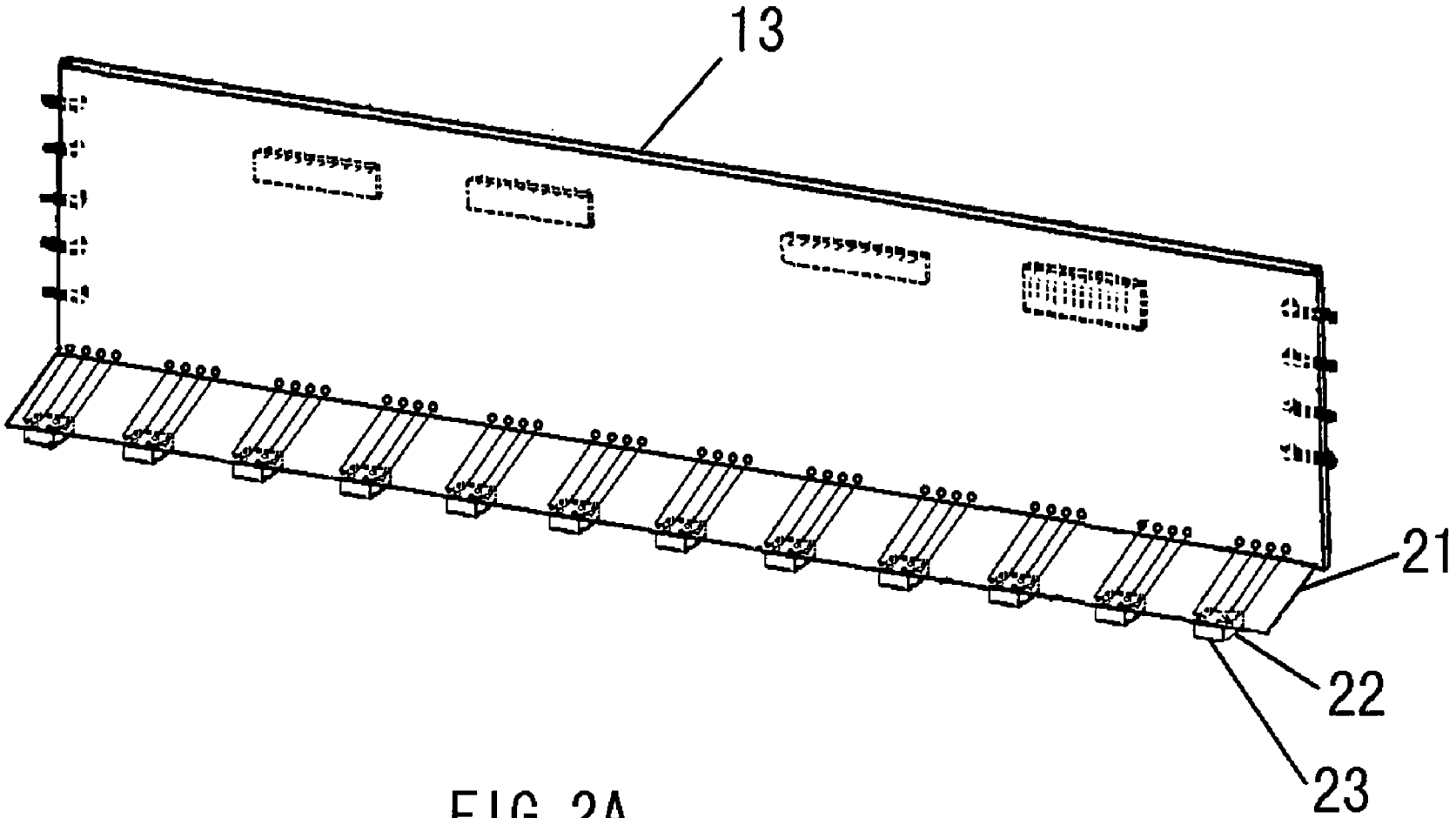
FIG. 2A illustrates a representative portion of the present invention fitted with at least one pair of optical transmissive couplers for each key.
Figure 2B:
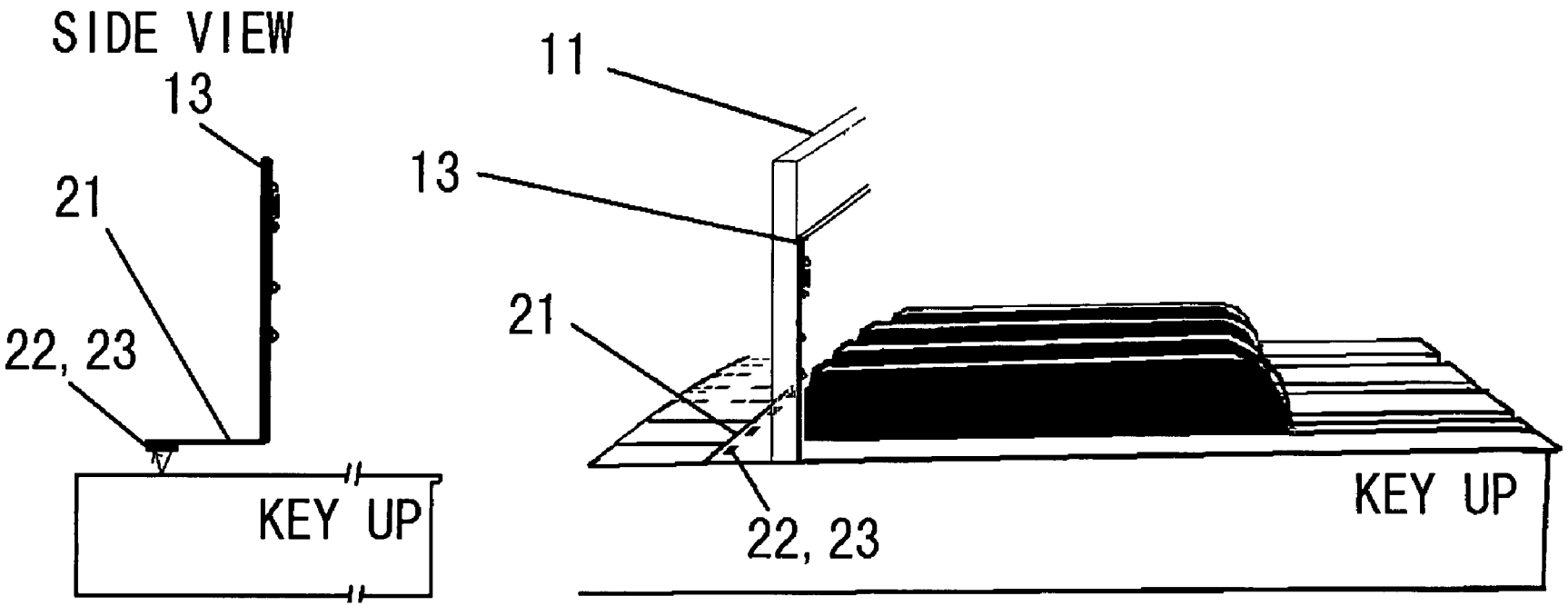
FIG. 2B illustrates how the present invention would appear after installation into the piano keyboard.

The exploded view of FIG. 2A shows the present invention fitted with at least one optical-transmissive coupler 22, 23 per key. As shown in FIG. 2B in the KEY UP position, the light received by the receiver 23 is at its maximum. As shown in FIG. 2C, as the key is played and moves to the KEY DOWN position, the key underneath the sensing strip sensing device moves down and away from emitter 22 and receiver 23. Less light from emitter 22 is reflected off the key and back to receiver 23, and receiver 23 signal decreases.

The exploded view of FIG. 3A shows the present invention fitted with at least one optical-transmissive coupler 22, 23 per key and reflective flexible member 24. Reflective flexible member 24 is used in the case where the natural reflectivity of the key is not suitable for direct light reflection. Reflective flexible member 24 can also be made up of a piezo-electric element. This arrangement would serve two purposes: flexible reflective piezo member 24 reflects light from emitter 22 back to optical receiver 23, and flexible reflective piezo member 24 would generate an electrical signal proportional to the velocity by which the key was depressed or released.

As illustrated in FIG. 3C, as the key is depressed to the KEY DOWN position, reflective flexible member 24 moves downward underneath sensing strip 21. Reflective flexible member 24 moves away from emitter 22 and receiver 23.

Less light from emitter 22 is reflected back to receiver 23, and receiver 23 signal decreases. If reflective flexible member 24 is piezo-electric material, its movement downward generates an electrical signal proportional to the velocity by which the key was depressed or released.

The exploded view of FIG. 4 shows the present invention with sensing strip 21 accommodating receiver 43 and flexible strip member 24 accommodating the emitter 42. The position of emitter 42 and receiver 43 are interchangeable. As illustrated in FIG. 4B, when the key is in the KEY UP position, emitter 42 and receiver 43 are at their closest proximity to each other and the amount of received energy is at its maximum. As illustrated in FIG. 4C, as the key is depressed to the KEY DOWN position, flexible member 24 moves downward accordingly and moves away from sensing strip 21. Emitter 22 moves away from receiver 23 accordingly. Less energy is received by receiver 43, and receiver 43 signal decreases.

Sensing strip 21 and flexible strip member 44 of FIG. 4 can also comprise a series of electrical conductive pads. Flexible strip member 44 is biased with step voltages at the conductive pads. When the key is up and at rest, the conductive pads on the flexible strip member make contact with all contact pads located on the sensing strip. The received voltage is at its maximum in this position. As the key is depressed, fewer conductive pads are in contact between sensing strip 21 and flexible strip member 44, and the received voltage begins to step down in strength. When the key is down, no or few pads are in contact, and the received voltage is at its minimum.

Although the present invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A system for use with a piano, organ, or musical keyboard, comprising:

an insertable sensor sensing either white key or black key movement or both white and black key movement, said sensor insertable between keys and a bottom surface of an open-position fallboard of the piano, organ or keyboard, said sensor sensing movement of a portion of the key behind the open-position fallboard, and said insertable sensor not requiring disassembly of the piano, organ or keyboard; and circuitry to process signals from said sensor and to process said key movement information.

2. The system of claim 1 wherein said insertable sensor detects key depression and said system further comprises a sensing strip operatively connected to said sensor for sensing movement of a portion of the key hidden from view.

3. The system of claim 2 wherein said sensing strip operatively connects to one or more sensors per key to sense a proportional amount of hidden key movement.

4. The system of claim 2 wherein said sensing strip is operatively connected to a flexible strip that moves in relation to an associated key and provides energy to said sensing strip that is proportional to an amount of said key movement.

5. The system of claim 4 wherein said sensing strip and said flexible strip comprise a magnetically coupled emitter and receiver that converts a magnetic field strength to a corresponding electrical signal proportional to a displacement of the key.

6. The system of claim 4 wherein said sensing strip and said flexible strip comprise a capacitively coupled emitter and receiver that converts an electric field strength to a corresponding electrical signal proportional to a displacement of the key.

7. The system of claim 4 wherein said flexible strip comprises a piezo-electric strip that converts mechanical energy to a negative or positive electrical signal proportional to a pressure by which the key is depressed or released.

8. The system of claim 4 wherein said sensing strip and said flexible strip comprise two or more electrical contact point pairs electrically biased that close when the key is at rest and open sequentially as the key is depressed.

9. The system of claim 4 wherein said sensing strip and said flexible strip comprise two or more optical coupler switches electrically biased that are switched on when the key is at rest and open sequentially as the key is depressed.

10. The system of claim 1 wherein said sensor comprises an energy contact and a corresponding energy receiving contact that by itself or when combined with another sensor produces an electrical signal strength proportional to said key movement of the key.

11. The system of claim 10 wherein said energy contact comprises an optical emitter and an optical receiver that converts reflected optical energy provided by a key surface to an electrical signal proportional to displacement of the key.

12. The system of claim 1 wherein said circuitry further processes key-note velocity.

13. The system of claim 1 wherein said circuitry transmits at least key-note ON/OFF information.

14. The system of claim 1 wherein said sensor further comprises an insertable protector to protect said sensor from ambient light interference.

* * * * *